United States Patent [19]

Tookey

[11] 4,264,212

[45] Apr. 28, 1981

[54] STATIC MIXER

[75] Inventor: David J. Tookey, Stevenage, England

[73] Assignee: Blue Circle Industries Limited, London, England

[21] Appl. No.: 38,648

[22] Filed: May 14, 1979

[30] Foreign Application Priority Data

May 26, 1978 [GB] United Kingdom ..... 23024/78

[51] Int. Cl.[3] ..... B28C 5/06; B28C 5/40; B01F 13/02

[52] U.S. Cl. ..... 366/3; 366/173; 239/433; 406/117; 417/151

[58] Field of Search ..... 366/2, 3, 4, 5, 10, 366/11, 342, 336, 177, 182, 183, 173; 239/433; 417/151; 406/117, 133, 128

[56] References Cited

U.S. PATENT DOCUMENTS

| | | | |
|---|---|---|---|
| 1,507,773 | 9/1924 | Hamm | 366/11 |
| 1,849,437 | 3/1932 | Rucker | 366/173 |
| 2,661,194 | 12/1953 | Katovsich | 366/11 |
| 3,871,583 | 3/1975 | Kellert | 366/11 |
| 4,106,111 | 8/1978 | Rose | 366/3 |

*Primary Examiner*—Robert W. Jenkins
*Attorney, Agent, or Firm*—Diller, Ramik & Wight

[57] ABSTRACT

According to the present invention a static mixer comprises a passage for the flow therethrough of a liquid or a suspension of particulate solid in a liquid, said passage having in the direction of flow a lengthwise divergent portion followed by a lengthwise convergent portion. An inlet for fluent material to be mixed with the suspension may converge with and project into the divergent portion. Cement and coal slurry may be mixed in this apparatus.

9 Claims, 1 Drawing Figure

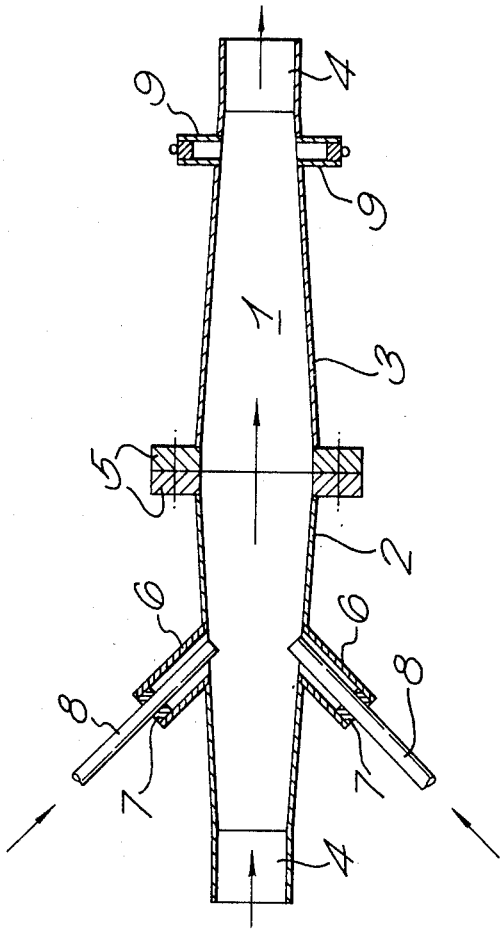
9
4
9
1
3
5
2
6
6
8
8
7
7
4

STATIC MIXER

The invention relates to the mixing of heterogeneous materials, particularly but not exclusively suspensions of particulate solids in liquids, such as slurries. The invention further relates to a static mixer for homogenizing such suspensions and for admixing with such suspensions other fluent materials, particularly pneumatically conveyable solids.

The invention is generally applicable to a wide variety of materials to be mixed or homogenised, where a liquid or a fluid suspension is to be mixed in itself or with a second flowable phase in subdivided form. The background to the invention is illustrated by reference to a particular case, namely the mixing of cement powder into a slurry.

In the construction of roof-supporting walls for roadways in mines such as coal mines, a known method is to pump to the formwork for the supporting structure a slurry comprising coal, water and a flow-promoting agent such as bentonite, and simultaneously a further slurry composed of a cementitious powder and water. It is then necessary to ensure that the two slurries are adequately mixed. Mixing may be attempted outside or within the formwork but in either case adequate mixing is difficult to ensure, for example by reason of space or machinery restriction or for other reasons connected with the rapid-setting properties of the special cement used.

A further disadvantage of using two slurries is that the proportion of water in the final mix tends to be too high. Because of the need to ensure that flow of each slurry is maintained, the maximum ratio of solids to water in each primary slurry is subject to restriction. A further disadvantage of using a cement slurry pipeline is that operational difficulties in the mine may lead to delays, in the course of which the cement slurry (being of a quick setting nature) in the pipeline may solidify with consequent loss of the pipe. In any event it will be necessary at the end of the placing operation to flush the cement slurry pipe with water.

It is further desirable to reduce the dust nuisance associated with the use of cement in mines, particularly coal mines. In current practice the cement is taken to the underground site in bags, which are then broken open, the cement being fed manually to a paddle mixer with a supply of water, thus forming the cement slurry or grout, which is transported to the placing point through the slurry pipeline by means of a grout pump. Alternatively the cement may be taken underground by means of a bulk transporter of the kind described in United Kingdom patent Specification No. 32849/76, from which it is further transported to the mixer pneumatically.

In either method just described it is difficult to avoid substantial dust emission at the mixing point, except by the addition of gas-cleaning equipment, for which sufficient space may not be available in the mine.

It is an object of the invention to provide means and a method for adequate mixing of components into a final suspension or slurry. It is a preferred object to achieve provision close to the site of use, avoiding the risk of premature mixing of sensitive components. It is a further preferred object to mix components with minimised or eliminated loss of solid powder by dust emission in the neighbourhood of the mixing point. It is a general object to attain similar advantages in the mixing or homogenising of liquids and suspensions of all kinds.

The invention is based on the discovery that the desired mixing can be achieved by means of a duct or pipe having a certain simple longitudinal internal profile and constituting an in-line static mixer.

According to the present invention a static mixer comprises a passage for the flow therethrough of a liquid or a suspension of particulate solid in a liquid, said passage having in the direction of said flow a lengthwise portion with a divergent wall followed by a lengthwise portion with a convergent wall, and optionally at least one inlet converging with and obtruding into the divergent portion for fluent material to be mixed with the suspension.

The invention also provides a method of homogenising a liquid or a suspension of particulate solid in a liquid or mixing a fluent material with such a liquid or suspension, by passing the materials to be mixed through a static mixer as defined above.

Typically the passage will be constituted by a pipe, or series of lengths of pipe, of circular cross-section although departures from such cross-section are within the scope of the invention. The divergent and convergent portions may be exactly similar, i.e. lengths of pipe differing only in their orientation, joined end to end at their wider ends.

Each divergent portion is preferably provided with at least one inlet, more preferably two diametrically opposed inlets through the divergent side wall of the portion, for fluent material such as pneumatically conveyed powder to be introduced into a suspension flowing through the portion, for instance cement into a slurry. Preferably each such inlet is in the form of a pipe defining a path for the fluent material which converges with the passage through the mixer in the direction of divergence of the portion, i.e. in the direction of flow of the suspension in the passage. The inlet pipe projects at least slightly into the main flow passage defined by the divergent wall portion in order to facilitate the drawing of inlet material into the main stream.

Where a suspension is to flow through the passage it may be any suspension of particulate solid in a liquid, capable of being conducted along a pipe, and conversely the diametrical dimensions of the mixer passage are chosen to accommodate the nature of the suspension. The passage should be wide enough to cater for the free rearrangement of components being mixed, without being too large to have sufficient influence on the components or from the viewpoints of economy or convenience; it should not be so narrow at any point that the solids will tend to block the passage, e.g. in the extreme not narrower than 5 times the diameter of the largest suspended particles. In general the ends of the mixer will advantageously have substantially the same internal diameter as the pipeline or other conveyor supplying the suspension to the mixer or delivering the mixed suspension from it.

The fluent material added may be any material capable of flowing along a pipe whether liquid, suspension in liquid, gaseous, or gas-suspended solid or liquid, and the inlets are dimensioned to accommodate the flow.

The angles of divergence and convergence, and the rates of flow of materials to be mixed, are chosen or adjusted to suit the nature of the materials and the desired throughput. In a particularly advantageous application of the invention the mixer forms a part of the outlet for the prepared mixture, in-line with the slurry supply pipe, close to the point of use, where it can be readily deployed in a relatively confined space, and turned on and off according to requirements without detriment to upstream equipment.

In many of the applications of this invention, the flow from the mixer will be close to the point of use. Under such circumstances, when the pressure inside the mixer will be relatively low, we have found no evidence of a tendency for back flow of the hydraulic suspension along the supply lines which feed the side inlets, even though the pressure, e.g. pneumatic pressure, in these supply lines is of the same order as the hydraulic pressure at the point of injection. Thus there is no need, in such cases, for the side inlets to be fed from a high pressure source. The relative pressures required are determined by the particular application and the dimensions and design of the apparatus.

The invention will now be further described by way of illustration with reference to the accompanying drawings which represent in diagrammatic longitudinal cross-section a static mixer according to the invention.

In the FIGURE, there is shown a passage defined by a divergent wall portion 2 and a convergent wall portion 3, both portions being circular in cross-section and terminating at an outer end 4 with a cylindrical portion for attachment to slurry pipework and at an inner end 5 with a flange for fastening the portions together end to end.

The divergent and convergent portions may for instance each be about 60 cm in length, with an internal diameter at one end of 10 cm and at the other end of 15 cm.

The wall portions 2 and 3 diverge and converge respectively in a linear manner.

In general, the ratio of the length L of each divergent or convergent portion, to the minimum diameter $D_1$ of the portion, may vary from 2:1 to 20:1 and the ratio of the maximum diameter $D_2$ of the portion to the minimum diameter $D_1$ may vary from 1.1:1 to 10:1.

The divergent portion 2 is made with two opposed inlet branches 6 of 50 mm diameter fitted with reducing bushes 7 to accommodate externally threaded 18 mm pipes 8 which accept rubberised canvas hoses for carrying pneumatically conveyed cement. The pipes 8 converge at about 45° with the longitudinal axis of the mixer, and protrude into the passage 4 to the extent that the innermost edge of each pipe 8 is inside and about 6 mm from wall 2 but is adjustable.

Branches 9 are shown on portion 3 for use as additional inlets if desired, which are plugged to close them when not in use.

Coal slurry from a pump may be introduced at input end 4 of portion 2 and passed along passage 1 while cement powder in the requisite minor proportion with respect to the slurry is fed in through the inlets 8. The configuration of the passage 1 results in thorough mixing of the cement into the slurry and the issue of the resultant intimate mixture at output end 4 of portion 3.

The apparatus of the invention can be easily made from readily accessible parts and materials.

Regardless of any theory as to the reason for the excellent mixing influence of the passage profiled according to the invention, it is apparent that it acts to homogenise the contents flowing through the passage, with or without a component added at the lateral inlets.

Accordingly the advantages of the invention can be attained in widely varied fields of application besides the mining industry, tunnelling operations and the transportation of slurries. Examples of such fields are the handling of emulsions in the oil and other industries, of pigment, filler and other suspensions in the paper industry and paint industry, civil engineering and building e.g. adding cement to sand or aggregate, foundry, cosmetics, pharmaceuticals e.g. adding dry ingredients to medicinal emulsions, and food manufacture e.g. addition of sugar to foods, where thorough mixing is important and continuity offers special advantages; and in any industry in which a powder or a granulated material is to be added to a liquid or suspension on a continuous basis, indeed in any industry which uses suspensions.

What is claimed is:

1. A method of mixing which comprises passing a liquid to be mixed through a passage having in the direction of flow a lengthwise portion with a divergent wall followed by a lengthwise portion with a convergent wall with the lengthwise portions diverging and converging in a linear manner, and introducing fluent material into the divergent portion of the passage through at least one inlet channel converging with and projecting into said divergent portion for mixing with said liquid.

2. A method according to claim 1 wherein the liquid contains solid particulate matter.

3. A method according to claim 1 wherein the fluent material is pneumatically conveyed powder.

4. A method according to claim 3 wherein said liquid containing solid particulate matter is coal slurry and said powder is cement.

5. A static mixer comprising a passage for the flow therethrough of a liquid, said passage having in the direction of flow a lengthwise portion with a divergent wall followed by a lengthwise portion with a convergent wall, at least one inlet channel converging with and projecting into said divergent portion of the passage for introducing fluent material to be mixed with the liquid, said lengthwise portions diverge and converge in a linear manner, said divergent wall and said convergent wall each having an innermost curved surface against and along which fluent material flows, and each said innermost curved surface being formed by the frustum of a right cone and being generally smooth and uninterrupted.

6. The mixer according to claim 5 wherein said divergent wall and convergent wall each join a respective cylindrical inlet portion and outlet portion, and means at said convergent wall adjacent the cylindrical outlet portion thereof for connecting at least one additional inlet channel to said convergent wall.

7. The mixer according to claim 6 including flange means joining said convergent wall to said divergent wall.

8. The mixer according to claim 5 including means carried by said convergent wall for connecting at least one additional inlet channel to said convergent wall.

9. The mixer according to claim 5 including flange means joining said convergent wall to said divergent all.

* * * * *